United States Patent [19]

Cassiano et al.

[11] Patent Number: 4,650,355

[45] Date of Patent: Mar. 17, 1987

[54] MULTICOLOR INKED RIBBON CARTRIDGE AND RELATED POSITIONING MECHANISM FOR AN IMPACT SERIAL PRINTER

[75] Inventors: Cosimo Cassiano, Sedriano; Fabio Pessina, Rho, both of Italy

[73] Assignee: Honeywell Information Systems Italia, Milan, Italy

[21] Appl. No.: 724,135

[22] Filed: Apr. 16, 1985

[30] Foreign Application Priority Data

Apr. 16, 1984 [IT] Italy ..... 20554 A/84

[51] Int. Cl.[4] ..... B41J 32/02

[52] U.S. Cl. ..... 400/196.1; 400/208; 400/212; 400/216.1; 400/225; 400/240 A; 400/248

[58] Field of Search ..... 400/124, 194, 195, 196, 400/196.1, 207, 208, 208.1, 212, 216.1, 216.2, 225, 229, 234, 235.1, 240, 240.3, 240.4, 248, 247

[56] References Cited

U.S. PATENT DOCUMENTS

| | | | |
|---|---|---|---|
| 4,084,503 | 4/1978 | Pylant et al. | 400/196.1 X |
| 4,260,270 | 4/1981 | Cavallari | 400/124 |
| 4,280,767 | 7/1981 | Heath | 400/240.4 X |
| 4,368,993 | 1/1983 | Brass et al. | 400/216.2 |
| 4,391,540 | 7/1983 | Dougherty | 400/212 |
| 4,407,595 | 10/1983 | Gershnow | 400/240.4 X |
| 4,425,046 | 1/1984 | Van Horne et al. | 400/229 X |
| 4,468,143 | 8/1984 | Volke et al. | 400/196 X |
| 4,487,518 | 12/1984 | Enrini | 400/320 |

FOREIGN PATENT DOCUMENTS

| | | | |
|---|---|---|---|
| 0064626 | 11/1982 | European Pat. Off. . | |
| 2306836 | 11/1976 | France | 400/208 |
| 0025985 | 2/1982 | Japan | 400/240.4 |
| 0091282 | 6/1982 | Japan | 400/240.4 |
| 0098385 | 6/1982 | Japan | 400/196.1 |
| 0185289 | 10/1983 | Japan | 400/196.1 |
| 0067077 | 4/1984 | Japan | 400/212 |
| 1502760 | 3/1978 | United Kingdom | 400/196.1 |
| 1525203 | 9/1978 | United Kingdom | 400/196.1 |

*Primary Examiner*—Ernest T. Wright, Jr.

*Attorney, Agent, or Firm*—Nicholas Prasinos; John S. Solakian

[57] ABSTRACT

A multicolor inked ribbon cartridge for an impact serial printer comprising a ribbon housing body and two arms protruding from such body to allow the interposition of a ribbon portion between a printing head and a printing support for the whole length of the platen when the cartridge is rotatably attached to the frame of an impact serial printer by means of two lateral cylindrically-shaped projections provided on the body of a cartridge thus permitting rotation of the body around a common axis of said cylindrical projections, parallel to the platen. The cartridge rotation around such axis and therefore the positioning of a suitable multicolor band between the printing head and printing support is assured by a cam actuated by a motor and interacting with the body of such cartridge. The cartridge is further provided with a string made tight between the ends of its arms upon the multicolor ribbon portion which is interposed between the head and printing support. Such string is provided for slidably and rotatably attaching a ribbon positioning and guiding element, which follows the cartridge rotation, and at the same time, is suitably coupled to the carriage of the serial printer, to follow the printing head in its transverse shift in order to assure a correct positioning and tensioning of the subsequent zones of the multicolor ribbon contacted by the printing head.

5 Claims, 3 Drawing Figures

MULTICOLOR INKED RIBBON CARTRIDGE AND RELATED POSITIONING MECHANISM FOR AN IMPACT SERIAL PRINTER

BACKGROUND

1. Field of the Invention

The present invention relates to a multicolour inked ribbon cartridge and to a positioning mechanism of such cartridge in an impact serial printer.

2. Description of the Prior Art

An impact serial printer generally consists of a platen, a carriage moving parallel to the platen and a printing head (for example, of the needle type) mounted on the carriage and sequentially actuated during the carriage movement to generate a printed character row on a printing support arranged against the platen. Characters are printed utilizing an inked ribbon, typically black, arranged between the support and the printing head. Because of a need for multicolour printing, the impact printer manufacturers turned to inexpensive mechanisms which, when mounted on a conventional solid colour printer frame, changed it into a multicolour printer. This change was essentially enabled by using an inked ribbon cartridge where the ribbon is comprised of a plurality of longitudinal contiguous bands of different colour, and by providing the printer with an additional mechanism able to position such cartridge in order that the desired ribbon band is positioned between the printing head and the printing support. Most of the multicolour inked ribbon cartridges have a structure generally similar, except for width, to the ones having a solid color inked ribbon cartridges, and, like these, are supported by the printing carriage. In the multicolour printer, the carriage is provided with a cartridge housing platform, which can cover a plurality of positions with respect to the printing head. This plurality of positions is equal to the number of the multicolour ribbon bands. In this way the positioning of a selected band of the multicolour ribbon, between the platen and the printing head is obtained by suitably tilting the platform (and therefore the whole cartridge) relative to the printing head. This tilting can be performed at the end/beginning of a row serial printing process or during the printing process itself. In the first case the platform is provided with mechanisms of a mechanical type (spring, articulated arms, pawls) which interact with suitable cams arranged at the end/beginning of the printing run, as disclosed for example by U.S. Pat. Nos. 4,280,767 and 4,368,993. Solutions of this type greatly limit the printing speed as they compel the printing head to perform one full pass for each required colour, in order to print a character row.

To overcome the above difficulties electromechanical actuators have been utilized to control the mechanical devices enabling the relative shift of the housing platform of the multicolour inked ribbon cartridge relative to the printing head. In this manner several multicolour inked ribbon bands can be selectively interposed between the printing head and printing support during execution of the serial printing process. The electromechanical actuators can be mounted directly on the printing carriage, as disclosed in U.S. Pat. No. 4,407,595 for example. Alternately, in order not to make the carriage heavy and therefore increase its inertia, such mechanical actuators can be suitably attached to the printer frame, in a manner disclosed in U.S. Pat. No. 4,391,540.

A majority of positioning mechanisms of the multicolour inked band contained in a cartridge mounted on the printing carriage have a large number of mechanical components which, besides being expensive, do not allow for their easy assembly and their subsequent mounting on a solid colour serial printing frame. Moreover, mounting of the multicolour inked ribbon cartridges on a carriage according to the prior art is affected by a basic limitation. Because of the small size of the cartridge, the multicolour inked ribbon contained therein is not large enough to provide an adequate useful life of such cartridge. With black ribbon cartridges this problem is not particularly severe because the excellent chemical-physical characteristics of such ink assure that these cartridges can provide for the printing of several millions of printed characters. The life of a ribbon having coloured ink, different than the black one, for instance yellow, is however much lower because of the different chemical-physical characteristics of the ink. A multicolour serial printer therefore needs a multicolour inked ribbon larger than the one normally used for a solid-colour printer and therefore requires a corresponding larger cartridge. This need, together with the need for reducing the number of all the mechanical parts for positioning the multicolour ribbon has recently induced some manufacturers of serial printers to use multicolour inked ribbon cartridges of a larger size which are housed on a suitable platform mounted on the printer frame. These platforms, like the ones mounted on the printing carriage, are able to perform a shift relative as to the printing head. However this solution does not substantially reduce the number of mechanical components comprising the positioning mechanism of the multicolor ribbon. Consequently it is difficult to manufacture such components for use on the frame of a solid-colour serial printer.

Unlike the cartridges mounted on the printing carriage and moving transversely with it, where the ribbon portion between the printing head and printing support is minimum, the use of tranversally fixed cartridges causes the ribbon to be interposed between the printing head and the printing support for the entire length of the platen. As a result the platform itself must be provided with additional tensioning and guiding means so that the interposed ribbon portion does not vibrate between the printing head and the printing support during the printing process, and assures that such ribbon portion follow the movements of the cartridge housing platform correctly. More particularly, it is essential that the inked ribbon is correctly positioned each time in relation to the variable position along the printing line where the printing head is placed. These additional means make the positioning mechanism of the multicolour ribbon more complicated. What was needed was a cartridge that simplifies both the structure and the assembly of the devices which can be mounted on a conventional type printer and changing it into a multicolour printer.

OBJECTS OF THE INVENTION

It is an object of the invention therefore to provide an improved impact serial printer.

Another object of the invention is to provide an improved serial printer having an improved multicolour ribbon cartridge.

Still another object of the invention is to provide an improved positioning mechanism for a multicolour inked ribbon cartridge for an impact serial printer.

SUMMARY OF THE INVENTION

These and other objects of the invention are obtained by using the cartridge itself as a positioning mechanism for the multicolour ribbon. In other words, while the cartridge contained in the devices known in the art is only used for housing the multicolour inked ribbon, the cartridge of the present invention is an integral and active part of the positioning mechanism.

According to a first embodiment of the invention the cartridge, of a fixed type, that is to be mounted on the printer frame instead of the printing carriage, is comprised of a housing body for the multicolour ribbon and by two arms protruding from such body, said arms being provided with suitable openings for allowing the passage of the ribbon from one arm to the other during the printing process. The cartridge body has two lateral cylindrically-shaped projections which insert into two suitable housings of the printer frame sides. When assembled, the cartridge is able to pivot around the axis defined by its two projections, said axis being parallel to the platen and the ribbon portion extending between the two arms and is intended to be interposed between printing head and printing support for the whole length of the platen. The cartridge controlled rotation, and therefore the positioning of a suitable multicolour ribbon band between printing head and printing support, is assured by a cam actuated by a motor (for example a step motor) which interacts with the cartridge body.

It is therefore clear that in the instant invention the cartridge body itself performs the functions carried out in the prior art, by the housing platform of the cartridge.

According to another embodiment of the invention the cartridge is provided with a tight string between the end of the two arms of the multicolour portion which is interposed between the printing head and the printing support. This string is used to hook onto a positioning and guiding element of the ribbon. This guiding element sliding freely on the string during operation tends to follow the cartridge tilting. The ribbon positioning and guiding element is further hitched to the carriage and follows it in its tranverse movements in order to assure the correct position and tension of the multicolour ribbon zones contacted by the printing head during its transverse movement. These and other characteristics will appear clearer from the following description of a preferred embodiment of the invention and from the enclosed drawings.

DESCRIPTION OF A PREFERRED EMBODIMENT

Figure 1:
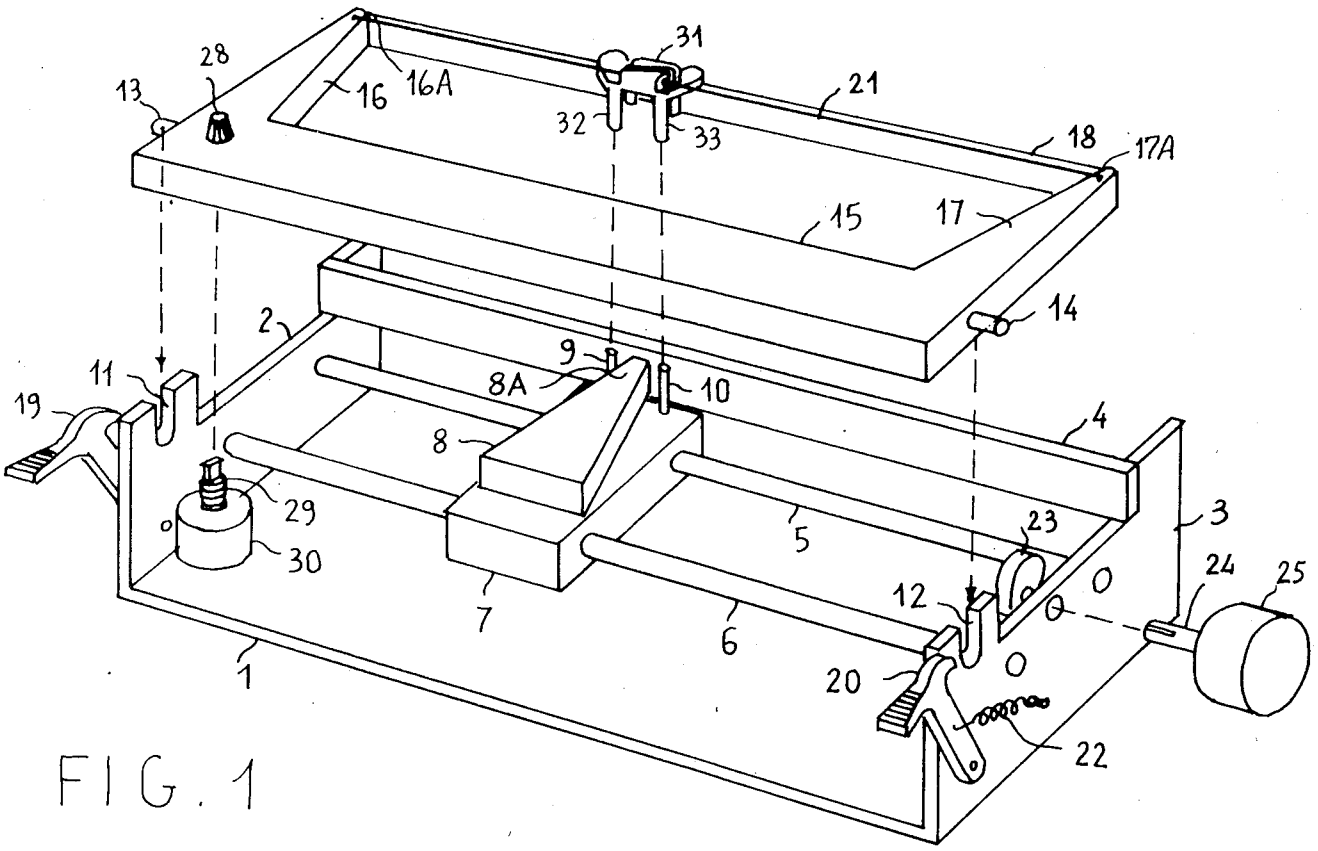
FIG. 1 is a perspective view showing the structure of a serial printer where a multicolour ribbon cartridge and the related positioning mechanism of the present invention are mounted.

Referring to FIG. 1, the printer comprises a frame comprised of a baseplate 1 and two sideplates 2, 3. Mounted between sideplates 2, 3 is a platen 4 and two parallel bars 5, 6. A carriage 7 can move along bars 5, 6. A printing head 8, for example of the needle type well known in the art and disclosed in U.S. Pat. No. 4,260,270, is mounted on carriage 7. The mechanism assuring the transverse movement of carriage 7 is not shown in FIG. 1 because such mechanism is not essential for an understanding of the invention and because it is well known in the art and is typically disclosed in U.S. Pat. No. 4,487,518. Carriage 7 is provided with two vertical pins 9, 10 arranged on the sides of printing head nose 8A. The function of such pins 9, 10 will be explained infra. Sideplates 2, 3 of the frame have two housings 11, 12 respectively, for insertion of two corresponding cylindrically-shaped projections 13, 14, protruding outside the body of a multicolour cartridge 15. Cartridge 15 is provided with two arms 16, 17 of suitable length and arranged with suitable openings 16A, 17A at their ends to enable the passage of ribbon 18 which typically is comprised of four longitudinal contiguous bands 18A, 18B, 18C, 18D of different colours. In the instant embodiment, the axis of projections 13, 14 does not intersect the barycenter of cartridge 15 so that when it is mounted on the printer frame it tends to rotate around its axis, because of its weight, in the direction which tends to lower the portion of ribbon 18 interposed between printing head 8 and platen 4 towards the base 1. Two hooks 19, 20 hinged on sideplates 2, 3 rotatably attach the cylindrically-shaped projections 13, 14, to sideplates 2 and 3 and permit rotation of the cartridge 15 around the axis of projections 13 and 14. Each hook 19, 20 is kept in a closed position by a spring 22. The angular position of cartridge 15, when mounted on the printer frame, is determined by its arm 17 resting on a cam 23. The cam 23 is splined to shaft 24 of a step motor 25 which is suitably mounted on sideplate 3. It is clear that by suitably rotating cam 23, cartridge 15 can be inclined relative to the printer plane in order that a predetermined band 18A, 18B, 18C, 18D of the multicolour ribbon 18 is interposed between end 8A of printer head 8 and platen 4.

Figure 2:
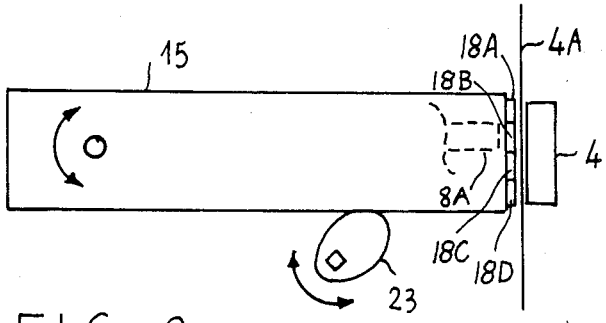
FIG. 2 schematically shows a side view of the multicolour ribbon cartridge and the related positioning mechanism of the present invention.

The interaction between cam 23 and cartridge 15 is shown on FIG. 2 where the cartridge 15 and the related positioning mechanism of the present invention is schematically shown in side view. A paper printing support 4A laying against platen 4 is also shown in FIG. 2 as well as the placement of the four colour bands 18A, 18B, 18C, 18D of the ribbon 18.

Referring again to FIG. 1, inside the cartridge body a feeding roller (not shown) and a leaf spring (not shown) suitably presses against such roller and assures the advancement of ribbon 18 from arm 17 to arm 16. The feeding roller can be manually operated by a knurled knob 28 or, once the cartridge 15 is mounted on the printer, by an elastic joint 29 engaging the feeding roller axis. A motor 30 assures the rotation of joint 29. Suitable tension of ribbon 18 between the two arms 16, 17 is generally assured by an additional leaf spring (not shown) internal to arm 17. (A detailed description is omitted of the feeding and tension mechanisms of ribbon 18 internal to cartridge 15. These are well known in the art and an example of such mechanisms is disclosed in British Pat. No. 1,502,760. Also a detailed description of elastic joint 29 is omitted too as it is well known in the art and described in British Pat. No. 1,525,203. A nylon string 21 is tightly mounted between arms 16 and 17 of cartridge 15, upon ribbon 18. A positioning and tensioning element 31 of ribbon 18 is slidably attached to this string 21. Element 31, generally made of plastic material, can freely slide along string 21 but it is compelled to follow the lateral shifts of the string axis caused by the tilting of the cartridge 15 around pivots 13, 14. Element 31 further comprises two hollow pins 32, 33 which engage pins 9, 10 respectively when the cartridge 15 is mounted on the printer. Therefore element 31 slides both parallel to the printing line when fed by printing carriage 7, and perpendicular to this line because of the tilting of cartridge 15 and therefore of string 21.

Figure 3:
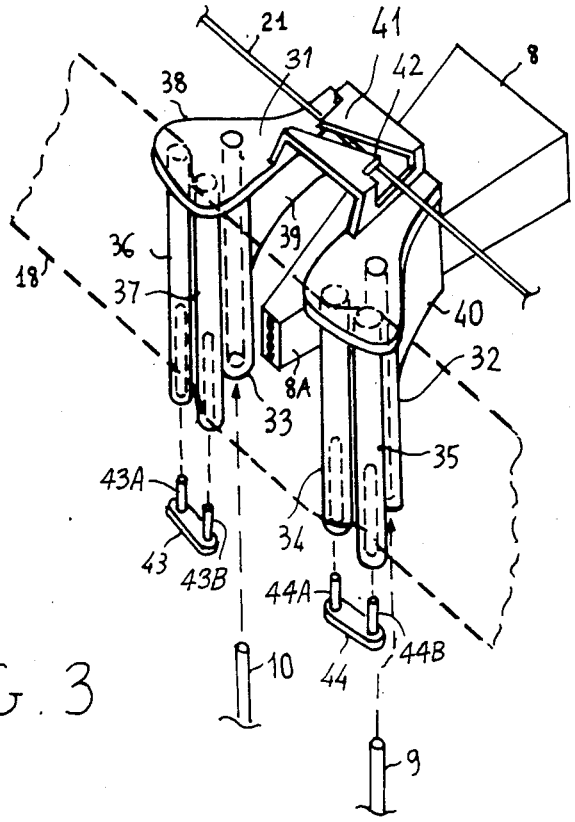
FIG. 3 shows in perspective the element which assures the local positioning and tension of the multicolour ribbon, and which is part of the multicolour ink ribbon cartridge of the present invention.

Referring to FIG. 3 there is shown a more detailed perspective view of local positioning and tensioning of plastic element 31. Besides hollow pins 32, 33 being capable of receiving pins 9, 10 respectively, element 31 comprises some additional hollow pins 34, 35, 36, 37. Such additional pins 34, 35, 36, 37 define a path for ribbon 18 and prevent possible vibrations which cause poor quality printing of such ribbon 18 during the printing process to propagate to the ribbon 18. It is to be noted that this portion is always interposed between end 8A of printing head 8 and printing support 4A of FIG. 2 as both printing head 8 and element 31 move tranversally with printing carriage 7 of FIG. 1. The relative position of the several pins 34, 35, 36, 37 is assured by a cap 38 to which one end of such pins 34, 35, 36, 37 is restrained. Some shoulders 39, 40 joining cap 38 to the external surface of pins 33, 32 respectively, provide the required stiffness to the element 31. Cap 38 is provided, on the top, with a pair of opposed teeth 41, 42 arranged to comprise a hook with a flat eye which is slidably attached to string 21. Two retaining elements 43, 44 provided with a pair of fingers 43A, 43B, 44A, 44B forced into the hollows of pins 36, 37 and 34, 35 engage the ribbon 18 and constrain it to follow the movement imposed by element 31 when such movement is perpendicular to the printing line.

It is clear that several changes may be made to the disclosed multicolour ribbon cartridge 15 and to the related positioning mechanism without departing from the scope of the present invention. For instance the cartridge 15 can be forced to lay with its arm 17 on cam 23 by means of suitable elastic means (for instance a leaf spring) mounted on the printer frame and interacting with the cartridge body.

What is claimed is:

1. A multicolour inked ribbon cartridge for an impact serial printer of the type having a frame, a printing head slidably mounted on a carriage, said printing head being capable of sliding parallel to a platen for printing a character row on a printing support which leans against said platen, said multicolour inked ribbon cartridge comprising:

a housing body for a multicolour ribbon formed by a plurality of longitudinal contiguous bands of different colours, said body being provided with two parallel arms so that a portion of said multicolour ribbon extends between the ends of said arms outside of said body, said portion of ribbon capable of being interposed between said printing head and said printing support along the entire printing line;

means integral to said body for rotatably attaching said cartridge to said frame so that such body is able to rotate around an axis parallel to the direction of movement of said printing head; and guiding means mounted on and extending between the ends of said two arms, said guiding means for transmitting the angular displacements of said cartridge to a positioning and tensioning element of subsequent zones of said ribbon portion which are interposed between said printing head and said printing support during the printing process, said element, in its transverse movement along the printing line together with said printing head, being able to slide along the axis of said guiding means, said element being coupled to said guiding means and also movable perpendicular to the direction of its transverse movement due to said cartridge rotation.

2. A mutlicolour ink ribbon cartridge as per claim 1, further characterized in that said guiding means is comprised of a string made tight between the ends of said two arms.

3. A positioning mechanism for a multicolour inked ribbon cartridge in an impact serial printer having a frame of the type wherein a printing head mounted on a carriage slides parallel to a platen for subsequently printing a character row on a printing support which leans against said platen, said cartridge comprising a housing body for a multicolour inked ribbon formed by a plurality of longitudinal contiguous bands of different colour, said body being provided with two arms between whose ends a portion of said ribbon extends freely outside said body, said ribbon portion being capable of being interposed between said printing head and said printing support along a whole printing line, said body being further provided with means for rotatably attaching said cartridge to said frame so that said cartridge is able to rotate around an axis parallel to the direction of movement of said printing head and having guiding means mounted on and extending between the ends of said two arms, said positioning mechanism comprising:

actuation means supporting and positioning said body of said cartridge at selectable angular positions;

a positioning and tensioning element of subsequent zones of said ribbon portion, which is interposed between said printing head and said printing support during the printing process;

first means to restrain, perpendicular to the printing line, said positioning and tensioning element to said guiding means; and second means to restrain, parallel to the printing line, said positioning and tensioning element to the group comprised by said printing head and said carriage.

4. A positioning mechanism for a multicolour inked ribbon cartridge as per claim 3, further characterized in that said first means comprises a pair of opposed teeth forming a hook with a flat eye, which is an integral part of said positioning and tensioning element, sliding along the axis of said guiding means.

5. A positioning mechanism for a multicolour inked ribbon cartridge as per claim 3 further characterized in that said second means comprises:

a shaft at least, integral to said carriage; and a hollow pin at least, integral to said positioning and tensioning element, said shaft being inserted in said hollow pin.

* * * * *